US008985424B2

(12) United States Patent
Miyashita

(10) Patent No.: US 8,985,424 B2
(45) Date of Patent: Mar. 24, 2015

(54) DRIVING TOOL

(75) Inventor: Isao Miyashita, Anjo (JP)

(73) Assignee: Makita Corporation, Aichi (JP)

( * ) Notice: Subject to any disclaimer, the term of this patent is extended or adjusted under 35 U.S.C. 154(b) by 720 days.

(21) Appl. No.: 13/286,692

(22) Filed: Nov. 1, 2011

(65) Prior Publication Data

US 2012/0111915 A1 May 10, 2012

(30) Foreign Application Priority Data

Nov. 4, 2010 (JP) ..... 2010-247634

(51) Int. Cl.
*B25C 1/06* (2006.01)
*B25C 5/16* (2006.01)

(52) U.S. Cl.
CPC ..... *B25C 1/06* (2013.01); *B25C 5/1689* (2013.01)
USPC ..... 227/8; 227/120; 227/125; 227/126

(58) Field of Classification Search
None
See application file for complete search history.

(56) References Cited

U.S. PATENT DOCUMENTS

| | | | | |
|---|---|---|---|---|
| 5,927,585 | A * | 7/1999 | Moorman et al. | 227/132 |
| 6,908,021 | B1 | 6/2005 | Wang | |
| 2009/0127310 | A1 | 5/2009 | Yu | |
| 2009/0206132 | A1 * | 8/2009 | Hueil et al. | 227/175.2 |

FOREIGN PATENT DOCUMENTS

| | | | |
|---|---|---|---|
| EP | 1 693 160 | A1 | 8/2006 |
| JP | A-2000-354981 | | 12/2000 |
| JP | A-2010-5714 | | 1/2010 |
| WO | WO 2008/032881 | A1 | 3/2008 |

OTHER PUBLICATIONS

Office Action issued in Japanese Application No. JP2010-247634 issued Feb. 24, 2014.
Partial European Search Report issued in European Application No. 11187647.0 dated Jun. 21, 2013.
Oct. 28, 2014 European Search Report issued in Application No. EP 11 18 7647.0.

* cited by examiner

*Primary Examiner* — Hemant M Desai
*Assistant Examiner* — Chinyere Rushing-Tucker
(74) *Attorney, Agent, or Firm* — Oliff PLC

(57) ABSTRACT

An improved driving tool is provided which can prevent malfunction in detection of the number of fasteners remaining in a magazine. A representative driving tool includes a driving member for driving fasteners and a magazine for storing the fasteners. The driving tool further includes a driving tool actuation control member that can be switched between an actuating position and a deactuating position, and a retaining member that can be switched between a retaining position and a releasing position. The retaining member is switched from the retaining position to the releasing position according to the number of remaining fasteners in the magazine and the driving tool actuation control member is switched from the actuating position to the deactuating position when the retaining member is switched to the releasing position.

7 Claims, 14 Drawing Sheets

DRIVING TOOL

BACKGROUND OF THE INVENTION

1. Field of the Invention

The invention relates to a driving tool having an idle driving prevention mechanism that prevents idle driving of fasteners such as nails.

2. Description of the Related Art

Japanese non-examined laid-open Patent Publication No. 2010-5714 discloses a driving tool having an idle driving prevention mechanism. In the known art, a remaining-number detecting switch for detecting the number of remaining fasteners is provided in a magazine which feeds fasteners in the form of nails onto a working axis of a driving member in the form of a driver. When the number of remaining fasteners is reduced to below a predetermined number, the remaining-number detecting switch is actuated to stop power supply to a motor.

According to the known driving tool, when a nail feeding member for feeding the nails from the magazine onto the working axis of the driving member reaches a predetermined position, the remaining-number detecting switch is actuated via a lever which is designed to be interlocked with the nail feeding member. Therefore, when smaller-diameter nails are used in this driving tool, a feed pitch of the nail feeding member accordingly gets shorter. As a result, the timing of switching the remaining-number detecting switch is susceptible to disturbance.

Specifically, after the remaining-amount detecting switch is once switched to a detecting state to output a detecting signal, it may be switched again to a non-detecting state not to output a detecting signal.

SUMMARY OF THE INVENTION

Accordingly, it is an object of the invention to provide an improved driving tool which can prevent malfunction in detection of the number of fasteners remaining in a magazine.

Above-described object can be achieved by the claimed invention. According to the invention, a representative driving tool has a driving member which moves rectilinearly and drives a fastener into a workpiece, and a magazine which stores a plurality of fasteners and feeds the fasteners one by one onto a working axis of the driving member. Further, the "driving tool" in the present invention typically represents a nailing machine or a tacker. The "fastener" may include a sharp-pointed straight rod-like fastener with or without a cap on its head, and other fasteners such as a U-shaped staple.

According to the invention, the driving tool has a driving tool actuation control member and a retaining member. The driving tool actuation control member can be switched between an actuating position to allow actuation of the driving tool and a deactuating position to prevent actuation of the driving tool and is constantly biased toward the deactuating position from the actuating position. The retaining member can be engaged with the driving tool actuation control member and switched between a retaining position to retain the driving tool actuation control member in the actuating position by engagement with the driving tool actuation control member and a releasing position to release the driving tool actuation control member by disengagement from the driving tool actuation control member. The retaining member is switched from the retaining position to the releasing position according to the number of remaining fasteners in the magazine, and the driving tool actuation control member is switched from the actuating position to the deactuating position when the retaining member is switched to the releasing position. Further, the manner of being "biased" in the present invention represents the manner in which the biasing force is applied to the driving tool actuation control member such that the driving tool actuation control member is switched to the deactuating position, and an elastic member such as a spring or rubber is typically used as a means of applying the biasing force. The timing "according to the number of remaining fasteners" typically represents the time at which the number of remaining fasteners reaches a predetermined number including zero.

According to the present invention, the retaining member is switched between a retaining position and a releasing position according to the number of fasteners remaining in the magazine, and when the retaining member is switched to the releasing position, the driving tool actuation control member is released from the retaining member. Therefore, when the driving tool actuation control member is released from the retaining member, the driving tool actuation control member which is constantly biased toward the deactuating position is switched to the deactuating position and held in this position. Specifically, according to the present invention, when the number of remaining fasteners reaches a predetermined number, the driving member is prevented from being actuated. Further, once switched to the deactuating state, this state can be maintained. Therefore, malfunction is not caused.

According to a further embodiment of the present invention, the driving tool has a cam member which can be moved to return the driving tool actuation control member from the deactuating position to the actuating position, and the driving tool actuation control member is returned to the actuating position by movement of the cam member. Further, the manner in which "the cam member is moved" in this invention suitably includes the manner in which the cam member is moved by user's manual operation of a cam operating member, and the manner in which the cam member is moved in relation to an operation for loading (refilling) fasteners into the magazine.

According to the present invention, the driving tool actuation control member is returned to the initial position or actuating position by movement of the cam member, so that the driving tool is allowed to be actuated.

According to a further embodiment of the present invention, the movement of the cam member for returning the driving tool actuation control member from the deactuating position to the actuating position is interlocked with refilling the fasteners into the magazine. Further, the act of "refilling the fasteners into the magazine" in the present invention typically represents the act of opening the slide door with respect to the magazine body in order to refill the fasteners into the magazine.

According to the present invention, return of the driving tool actuation control member from the deactuating position to the actuating position can be interlocked with refilling of the fasteners. Therefore, it is rational in that the user does not have to perform an additional returning operation.

According to the present invention, an improved driving tool is provided which can prevent malfunction in detection of the number of fasteners remaining in a magazine. Other objects, features and advantages of the present invention will be readily understood after reading the following detailed description together with the accompanying drawings and the claims.

BRIEF DESCRIPTION OF THE DRAWINGS

FIG. 8 is a view for illustrating the operation of the idle driving prevention mechanism, showing a state in which nails are remaining in a magazine, in which FIG. 8(A) shows the entire idle driving prevention mechanism, FIG. 8(B) is an enlarged partial view thereof, and FIG. 8(C) is an extracted view showing each of its components.

FIG. 9 is a view for illustrating the operation of the idle driving prevention mechanism, showing a state in which nails have run so low that a pusher has contacted a slide plate, in which FIG. 9(A) shows the entire idle driving prevention mechanism, FIG. 9(B) is an enlarged partial view thereof, and FIG. 9(C) is an extracted view showing each of its components.

FIG. 10 is a view for illustrating the operation of the idle driving prevention mechanism, showing a state in which the number of remaining nails has reached a predetermined number (idle driving prevention has started), in which FIG. 10(A) shows the entire idle driving prevention mechanism, FIG. 10(B) is an enlarged partial view thereof, and FIG. 10(C) is an extracted view showing each of its components.

FIG. 11 is a view for illustrating the operation of the idle driving prevention mechanism, showing a state of completion of idle driving prevention, in which FIG. 11(A) shows the entire idle driving prevention mechanism, FIG. 11(B) is an enlarged partial view thereof, and FIG. 11(C) is an extracted view showing each of its components.

FIG. 12 is a view for illustrating the operation of the idle driving prevention mechanism, showing a state at the beginning of return to the initial position (when a return plate starts to move), in which FIG. 12(A) shows the entire idle driving prevention mechanism, FIG. 12(B) is an enlarged partial view thereof, and FIG. 12(C) is an extracted view showing each of its components.

FIG. 13 is a view for illustrating the operation of the idle driving prevention mechanism, showing a state of completion of the movement of the return plate, in which FIG. 13(A) shows the entire idle driving prevention mechanism, FIG. 13(B) is an enlarged partial view thereof, and FIG. 13(C) is an extracted view showing each of its components.

FIG. 14 is a view for illustrating the operation of the idle driving prevention mechanism, showing a state of completion of return to the initial position, in which FIG. 14(A) shows the entire idle driving prevention mechanism, FIG. 14(B) is an enlarged partial view thereof, and FIG. 14(C) is an extracted view showing each of its components.

DETAILED DESCRIPTION OF THE INVENTION

Each of the additional features and method steps disclosed above and below may be utilized separately or in conjunction with other features and method steps to provide and manufacture improved driving tools and method for using such driving tools and devices utilized therein. Representative examples of the present invention, which examples utilized many of these additional features and method steps in conjunction, will now be described in detail with reference to the drawings. This detailed description is merely intended to teach a person skilled in the art further details for practicing preferred aspects of the present teachings and is not intended to limit the scope of the invention. Only the claims define the scope of the claimed invention. Therefore, combinations of features and steps disclosed within the following detailed description may not be necessary to practice the invention in the broadest sense, and are instead taught merely to particularly describe some representative examples of the invention, which detailed description will now be given with reference to the accompanying drawings.

Figure 1:
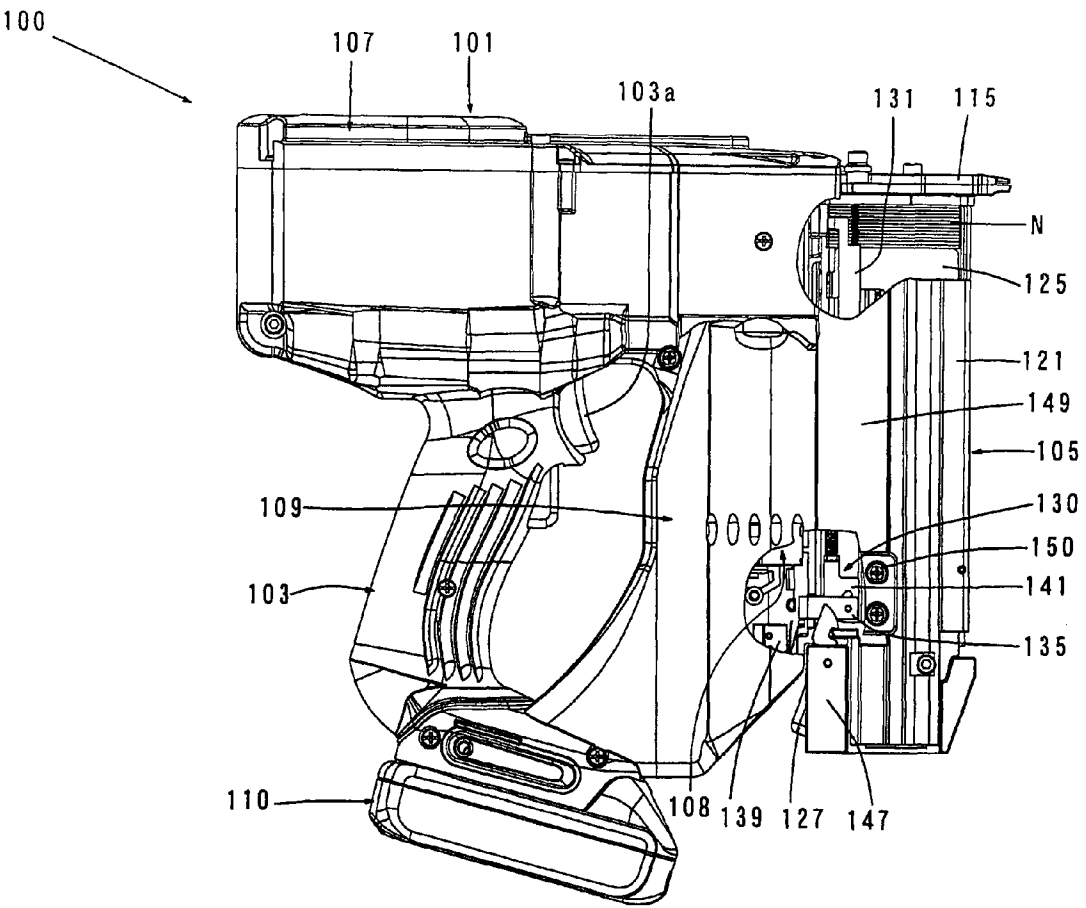
FIG. 1 is a right side view showing an entire construction of a nailing machine according to this embodiment.
Figure 2:
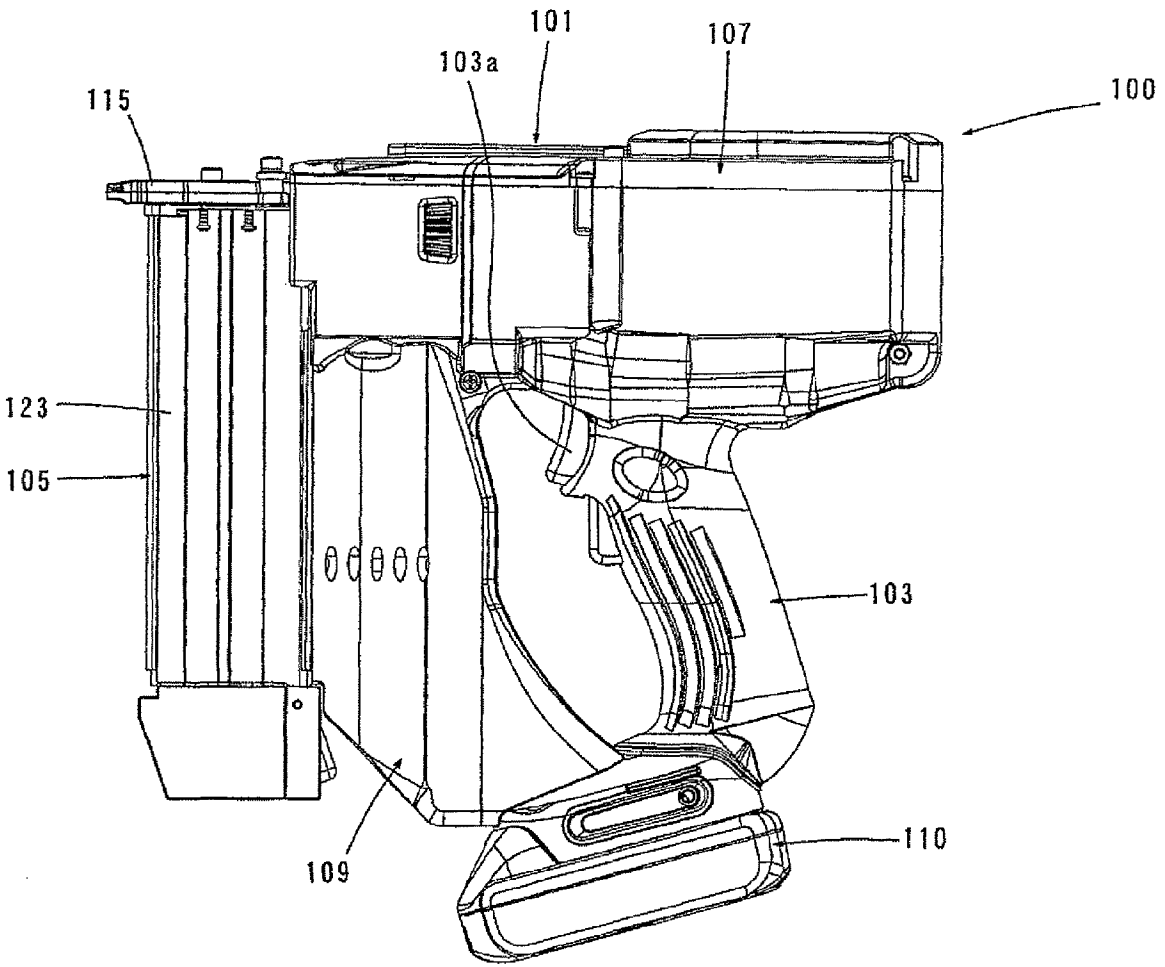
FIG. 2 is a left side view of the nailing machine.
Figure 3:
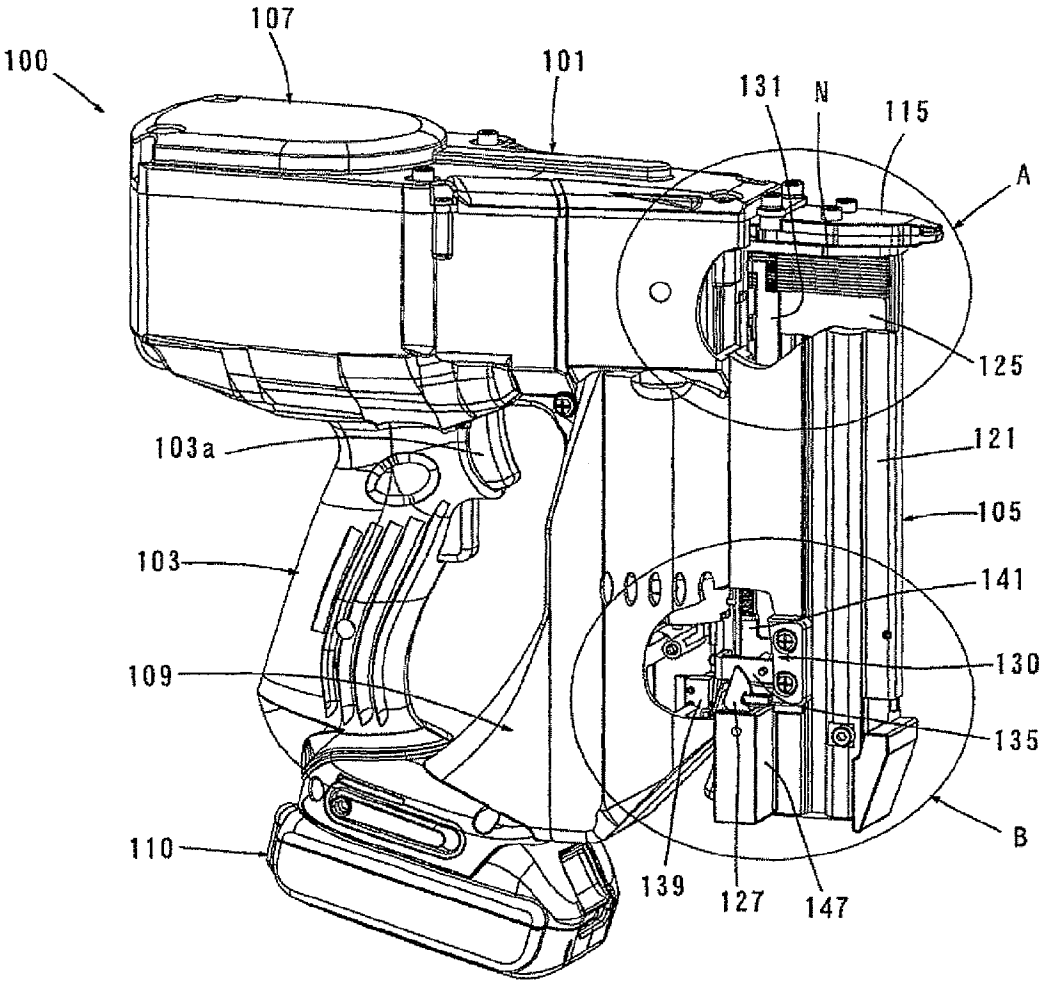
FIG. 3 is a perspective view of the nailing machine.

An representative embodiment of the invention is described with reference to FIGS. 1 to 14. In this embodiment, a battery-powered nailing machine 100 is explained as a representative example of a driving tool according to the invention. As shown in FIGS. 1 to 3, the nailing machine 100 mainly includes a tool body in the form of a body 101 that forms an outer shell of the nailing machine 100, a generally rod-shaped grip 103 designed to be held by a user, and a magazine 105 that stores (is loaded with) fasteners in the form of nails N to be driven into a workpiece. The grip 103 is integrally formed with the body 101 and extends from the side of the body 101 in a direction (downward as viewed in FIG. 1) transverse to a longitudinal direction of the body 101 (a horizontal direction as viewed in FIG. 1). A rechargeable battery pack 110 is mounted on an extending end (a lower end as viewed in FIG. 1) of the grip 103, and a driving motor 108 is powered from the rechargeable battery pack 110.

FIG. 1 shows the nailing machine 100 pointed to the right or with a front end of the body 101 pointed toward a workpiece (not shown) on the right side. Therefore, in FIG. 1, a rightward direction is a nail driving (injecting) direction (the longitudinal direction) in which a nail is driven by a driver 116. The driver 116 comprises an elongate rod-like member and serves as a nail driving member which moves rectilinearly in the longitudinal direction of the body 101 and moves forward within a nail driving channel of a driver guide 115 and drives the nail. The driver 116 is a feature that corresponds to the "driving member" according to the present invention. Further, for the sake of convenience of explanation, the side of the front end of the body 101 in the longitudinal direction (the right end as viewed in FIG. 1) is taken as the front and its opposite side as the rear. In a state shown in FIG. 1 in which an axis of the body 101 extends generally horizontally, the extending direction of the grip 103 is taken as the downward direction and its opposite direction as the upward direction.

A driver guide 115 is provided on the front end (the right end as viewed in FIG. 1) of the body 101 and forms an injection port for the nails N on a working axis of the driver. The magazine 105 is mounted to the front end region of the body 101 and extends generally parallel to the grip 103. Further, a nail feeding member in the form of a pusher 125 is provided within the magazine 105 and serves to push the nails N in a feeding direction (upward as viewed in FIG. 1). The pusher 125 feeds a nail N in every nail driving operation of the driver. With such a construction, the nails are fed one by one toward the nail injection hole of the driver guide 115 in an upward direction transverse to the driving direction.

The body 101 is generally L-shaped as viewed from the side and mainly includes a generally cylindrical body housing 107 extending in a longitudinal direction and a motor housing 109 which extends downward from a front end region of the body housing 107 and houses the driving motor. The motor housing 109 is disposed adjacent to the magazine 105 in a front end region of the body housing 107 and connected to the body housing 107. A driver driving mechanism (not shown) for driving the driver is housed within the body 101. The driver is caused to move rectilinearly by the driver driving mechanism which is driven by the driving motor. At this time, the driver strikes the nail N held standby in the nail driving channel of the driver guide 115, so that the nail N is driven into the workpiece. When a contact arm (not shown) provided adjacent to the driver guide 115 is pressed against the workpiece and then in this state, a trigger 103*a* disposed on the grip 103 is depressed once, or when the trigger 103*a* is depressed and then in this state, the contact arm is pressed against the workpiece, the driving motor is driven and one operation of driving in the nail N by the driver is performed. The driver driving mechanism for driving the driver is a known technique and not directly related to the present invention, and therefore its description is omitted.

The magazine 105 mainly includes a generally box-like magazine body 121 that stores a plurality of nails N joined together, for example, by an adhesive, a slide door 123 (see FIG. 2) and the pusher 125 that serves to feed the nails N one by one from the magazine body 121 into the nail driving channel of the driver guide 115. The slide door 123 is slidably mounted to the magazine body 121 in the feeding direction (the vertical direction perpendicular to the nail driving direction) of the nails N. Further, the slide door 123 is slid between an open position (to which the slide door 123 is moved downward with respect to the magazine body 121) in which the magazine body 121 is opened for nail loading and a closed position (to which the slide door 123 is moved upward with respect to the magazine body 121) in which the magazine body 121 is closed. In the closed position, the slide door 123 is locked to the magazine body 121 by a door lock 127.

An idle driving prevention mechanism 130 is now explained with reference to FIGS. 4 to 7. The idle driving prevention mechanism 130 serves to prevent the nailing machine 100 from performing a nail driving operation by de-energizing (cutting or interrupting power to) the driving motor when the number of nails N remaining in the magazine 105 reaches a predetermined number. The idle driving prevention mechanism 130 mainly includes a slide plate 131 which can move in the same direction (upward) as the direction of movement of the pusher 125, a switch block 135 which can move in a direction perpendicular to the direction of movement of the slide plate 131 or in the longitudinal direction of the body 101, an electric switch 139 which is turned on and off by the switch block 135, and a return plate 141 by which the electric switch 139 is returned from the off state to the on state. As for the above-described components of the idle driving prevention mechanism, the slide plate 131, the switch block 135 and the return plate 141 are mounted to the magazine body 121, and the electric switch 139 is mounted to the motor housing 109.

The slide plate 131 is provided as a detecting member for detecting that the number of remaining nails N have reached the predetermined number. The slide plate 131 is an elongate member extending in the vertical direction, and a vertically extending straight slot 132 (see FIGS. 4 and 7) having an open lower end is formed in one (lower) end of the slide plate 131 in the extending direction and a passive part 131*a* protruding in a direction transverse to the extending direction is formed on the other (upper) end of the slide plate 131 in the extending direction. The slide plate 131 is constantly biased downward by a biasing member in the form of a first spring 133. When the slide plate 131 is placed in a downward position by a biasing force of the first spring 133, the slot 132 of the slide plate 131 engages with (restrains) a pin-like engagement element 135*a* on the switch block 135, from above, so that the switch block 135 is held away from the electric switch 139 or in a position to turn off the electric switch 139. The state in which the engagement element 135*a* of the switch block 135 is engaged with the slot 132 of the slide plate 131 and the electric switch 139 is turned off is defined as an initial state. Further, the engagement element 135*a* protrudes substantially horizontally in a lateral direction from the side surface of the switch block 135. The first spring 133 is a coil spring which is elastically disposed between a top inner wall surface of the magazine body 121 and an upper end surface of the slide plate 131 and applies a downward biasing force to the slide plate 131.

When the number of remaining nails N becomes fewer, the passive part 131*a* comes in contact with an actuating protrusion 125*a* formed on the pusher 125. Thereafter, when the pusher 125 is moved upward to feed the nails, the slide plate 131 is pushed up by the actuating protrusion 125*a*. The actuating protrusion 125*a* protrudes in a direction transverse to the nail feeding direction and opposed to the passive part 131*a* in the vertical direction. When the number of remaining nails N reaches the predetermined number, the slide plate 131 reaches a predetermined upper end position. At this time, the engagement element 135*a* is disengaged from the slot 132. The slide plate 131 is a feature that corresponds to the "retaining member" according to this invention. The downward position or initial position in which the slot 132 of the slide plate 131 is engaged with the engagement element 135*a* of the switch block 135 is a feature that corresponds to the "retaining position" according to this invention. An upper end position in which the engagement element 135*a* is disengaged from the slot 132, is a feature that corresponds to the "releasing position" according to this invention.

Figure 7:
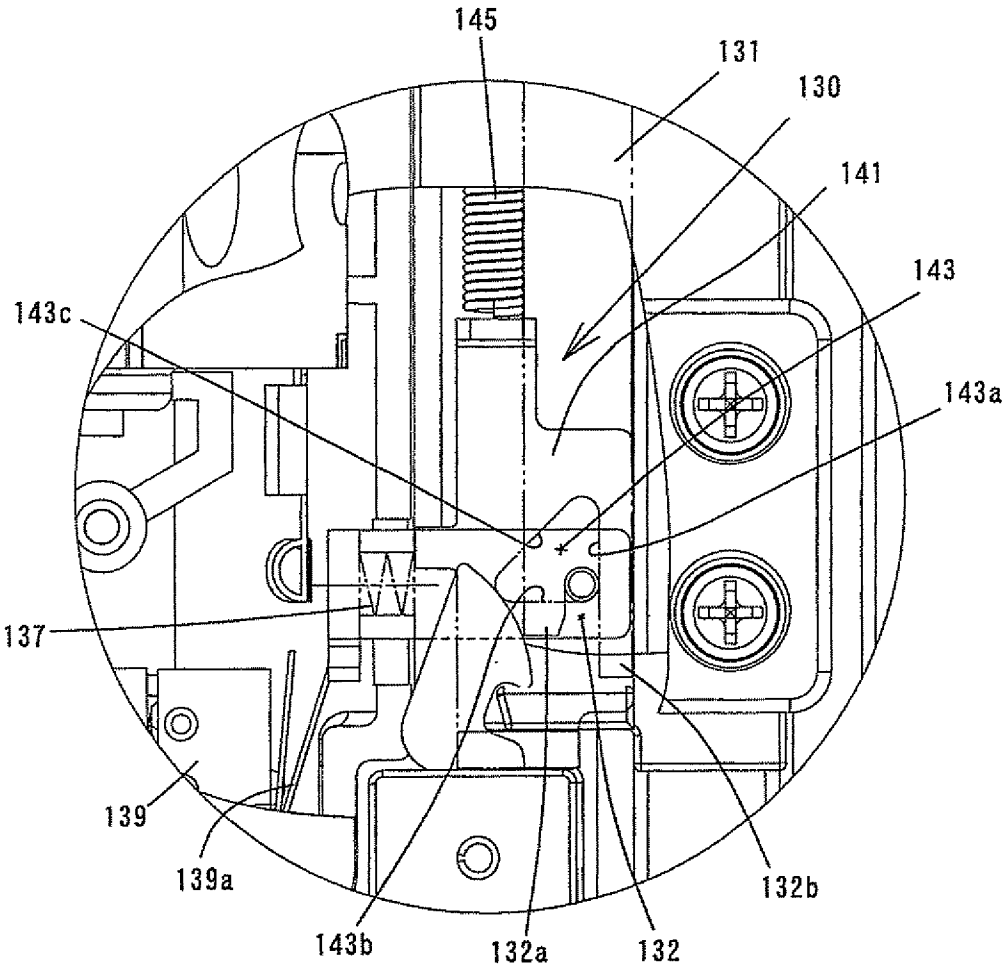
FIG. 7 is an enlarged view of part C in FIG. 4.

The switch block 135 is provided as a control member for controlling driving of the driving motor when the number of remaining nails N reaches the predetermined number. Until the number of remaining nails N reaches the predetermined number, the engagement element 135*a* is held engaged with the slot 132 of the slide plate 131, so that the switch block 135 which can move in the longitudinal direction of the tool body is held in a forward position to be placed away from the electric switch 139. The switch block 135 is constantly biased toward the electric switch 139 (rearward) by a biasing member in the form of a second spring 137. Therefore, when the slide plate 131 is moved upward and the engagement element 135*a* is disengaged from the slot 132 of the slide plate 131 (separated from a rear wall 132*a* of the slot 132), the switch block 135 is moved rearward by the biasing force of the second spring 137 and turns the electric switch 139 from the off state to the on state by pressing an actuating element 139*a* of the electric switch 139. Further, as shown in FIG. 7, the slot 132 is designed such that the rear wall 132*a* has a length shorter than the front wall 132*b* in the vertical direction. The switch block 135 is a feature that corresponds to the "driving tool actuation control member" according to this invention. The forward position or initial position in which the switch block 135 is placed away from the electric switch 139 and turns off the electric switch, is a feature that corresponds to the "actuating position to allow actuation of the driving tool" according to this invention. The rearward position in which the switch block 135 is placed close to the electric switch 139 and turns on the electric switch, is a feature that corresponds to the "deactuating position to prevent actuation of the driving tool" according to this invention. The second spring 137 is a coil spring which is elastically disposed between the magazine body 121 and the switch block 135 and applies a rearward biasing force to the switch block 135.

The electric switch 139 can be switched between a power supply position in which power is supplied to the driving motor and a power shutoff position in which the power supply is shut off. In this embodiment, the off position of the electric switch 139 is defined as the power supply position and the on position as the power shutoff position. When the electric switch 139 is switched to the on state, a switching signal of the electric switch 139 is inputted to a controller (not shown) for controlling the driving motor. When the switching signal of the electric switch 139 is inputted, even if the contact arm is pressed against the workpiece and the trigger 103*a* is depressed, the controller prevents energization of the driving motor, so that idle driving of the nails N can be prevented.

A return plate 141 is provided as a reset member and causes the driving motor to return from the energization prevented state or idle driving prevented state to the energization allowed state (initial state). The return plate 141 is a vertically extending cam plate and has a side surface region overlapping a side surface of the switch block 135 in the lateral direction. As shown in FIG. 7, a generally right-angled triangular engagement hole 143 through which the engagement element 135*a* is inserted is formed in the side surface region of the return plate 141. Specifically, the engagement hole 143 of the return plate 141 has a rear surface 143*a* extending straight in the vertical direction, a bottom surface 143*b* extending horizontally in the longitudinal direction and an inclined surface 143*c* extending straight between an upper end of the rear surface 143*a* and a rear end of the bottom surface 143*b*.

The return plate 141 is constantly biased downward by a biasing member in the form of a third spring 145, and a lower surface of the return plate 141 is held in contact with a top of a stopper 147 provided on the slide door 123 of the magazine 105 so that the return plate 141 is prevented from moving downward. In the initial state in which the engagement element 135*a* of the switch block 135 is engaged with the slot 132 of the slide plate 131, the return plate 141 is placed in a position to be prevented from moving downward by the stopper 147, and the engagement element 135*a* is placed in a region of intersection (a lower right corner as viewed in FIG. 7) of the rear surface 143*a* and the bottom surface 143*b* of the engagement hole 143. The third spring 145 is a coil spring which is elastically disposed between the magazine body 121 and the upper end surface of the return plate 141 and applies a downward biasing force to the return plate 141.

When the electric switch 139 is turned on by rearward movement of the switch block 135 and idle driving is prevented, the engagement element 135*a* of the switch block 135 is opposed to both the inclined surface 143*c* of the engagement hole 143 and the lower surface of the rear wall 132*a* of the slot 132 of the slide plate 131 with respective predetermined spaces. In this state, when the slide door 123 is opened (slid downward) and the stopper 147 is disengaged from the return plate 141, the return plate 141 acted upon by the biasing force of the third spring 145 is moved downward. Thus, the inclined surface 143*c* of the engagement hole 143 pushes the engagement element 135*a* and returns the switch block 135 to the forward initial position. Specifically, the inclined surface 143*c* of the engagement hole 143 serves as a cam face and pushes a cam follower in the form of the engagement element 135*a*. The return plate 141 is a feature that corresponds to the "cam member" according to this invention.

Figure 4:
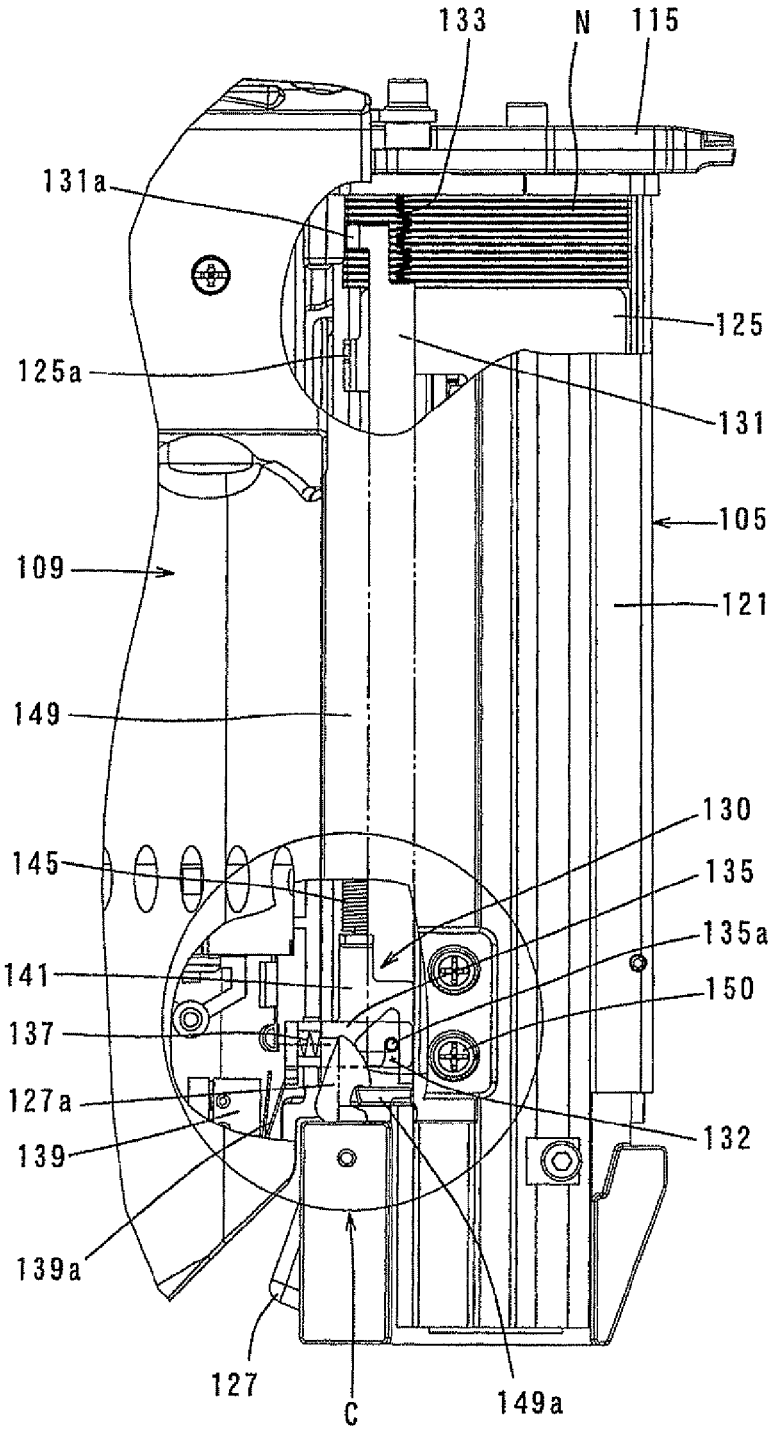
FIG. 4 is a partial view of an idle driving prevention mechanism.
Figure 5:
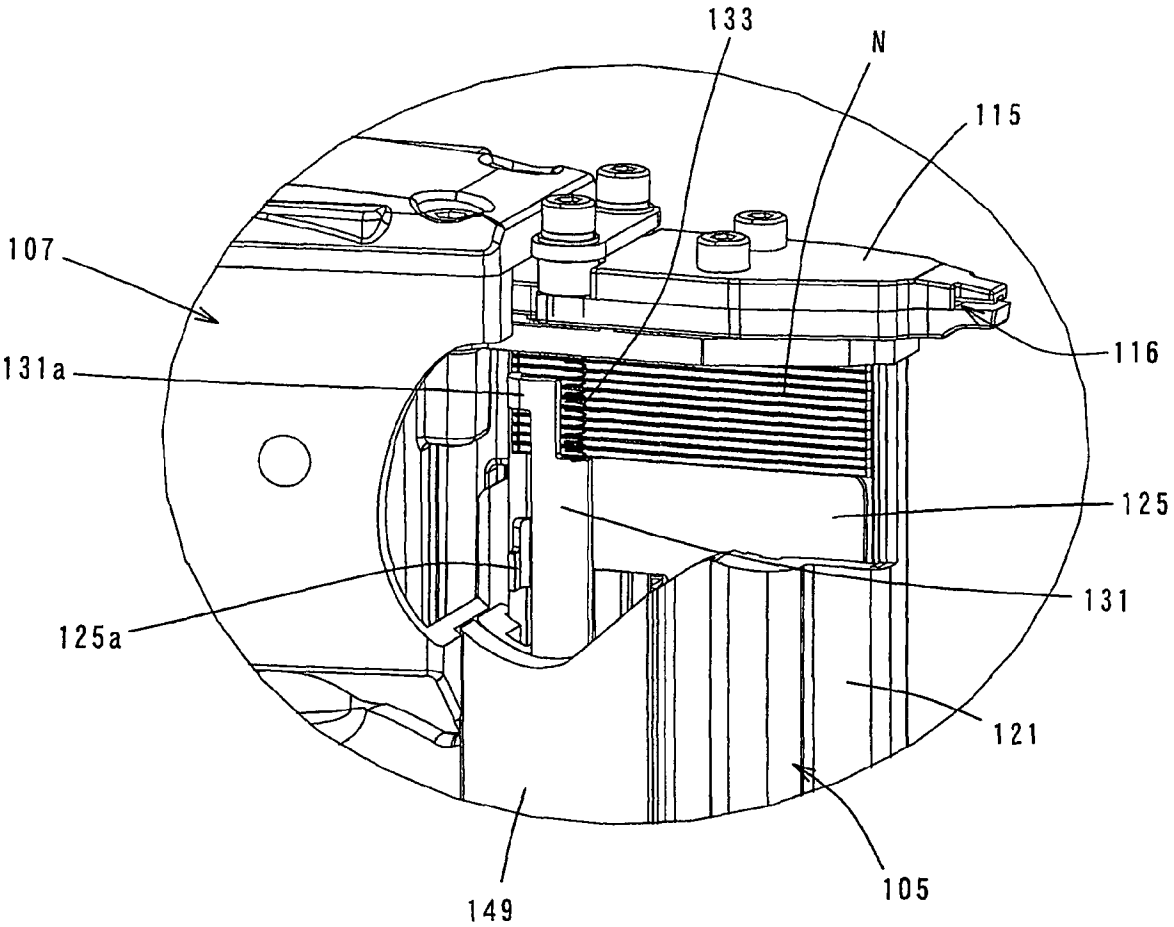
FIG. 5 is an enlarged view of part A in FIG. 3.
Figure 6:
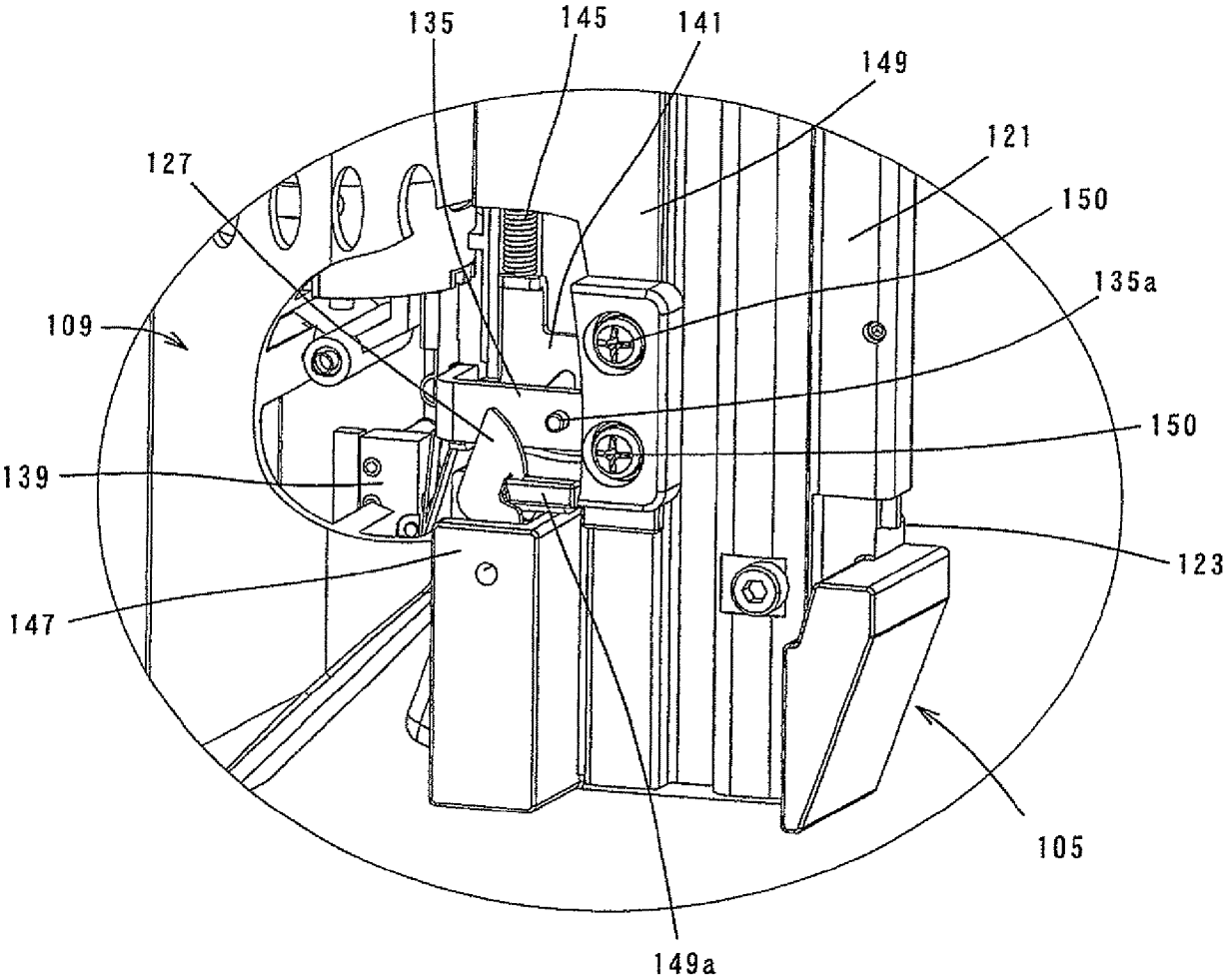
FIG. 6 is an enlarged view of part B in FIG. 3.

The slide plate 131, the switch block 135 and the return plate 141 of components of the idle driving prevention mechanism 130 are housed in the magazine body 121 and covered by a covering member 149 (see FIG. 4). The covering member 149 is detachably fastened to the magazine body 121 by a plurality of screws 150. Further, a rear end part of the switch block 135 protrudes outside the magazine body 121 and the protruding rear end surface faces the actuating element 139*a* of the electric switch 139. An engagement part 149*a* for engagement with a hook 127*a* of the door lock 127 on the slide door 123 is provided on the covering member 149.

Figure 8:
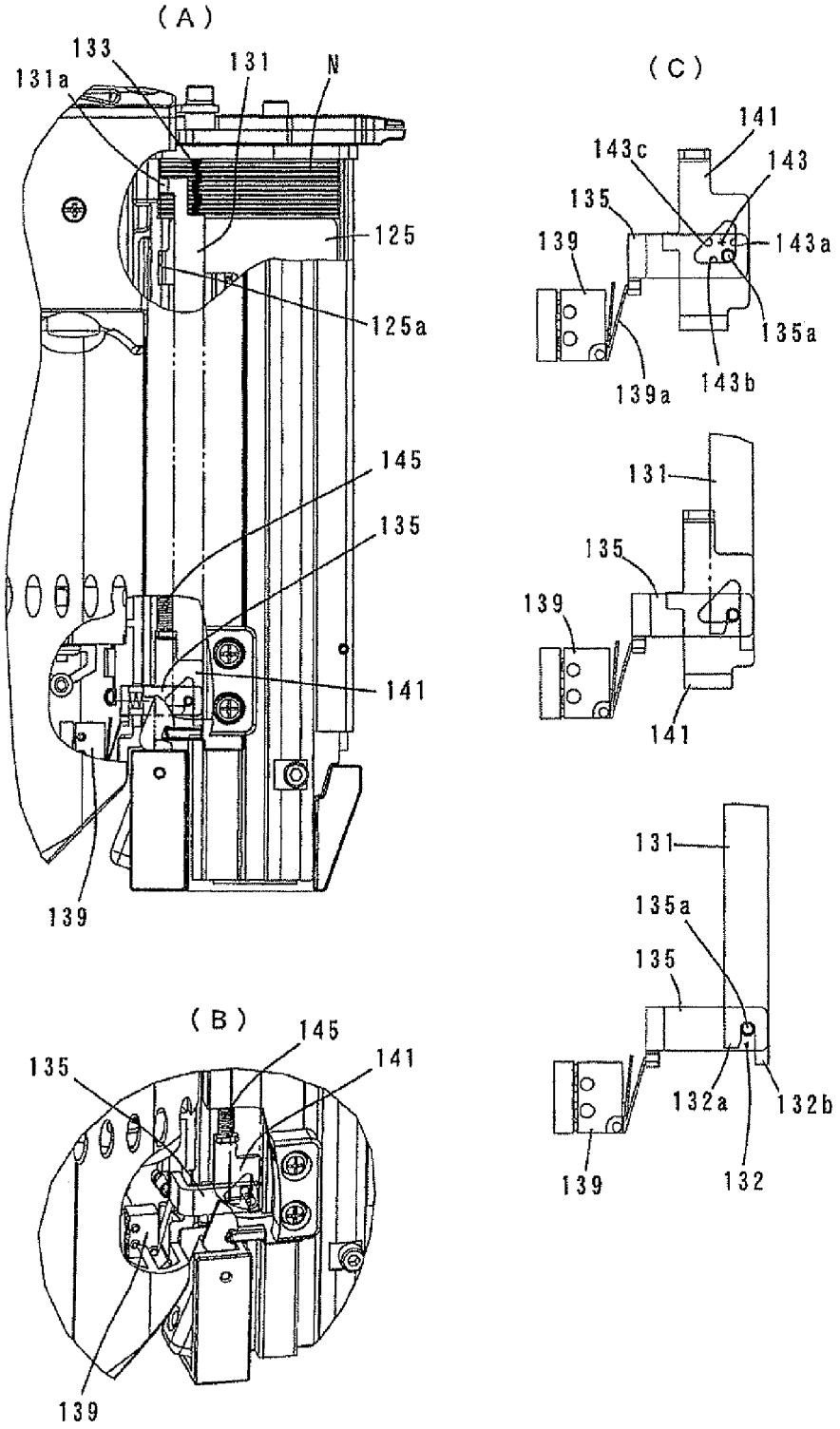

The nailing machine 100 having the idle driving prevention mechanism 130 according to this embodiment is constructed as described above and the operation of the idle driving prevention mechanism 130 is shown step by step in FIGS. 8 to 14. FIG. 8 shows an initial state in which a predetermined number of nails N remain in the magazine 105. In this case, the slide plate 131 acted upon by the downward biasing force of the first spring 133 is placed in the downward position and the engagement element 135*a* of the switch block 135 is engaged with the slot 132. The switch block 135 is held in the forward position and the electric switch 139 is in the off state, so that the nail driving operation of the nailing machine 100 is allowed.

Figure 9:
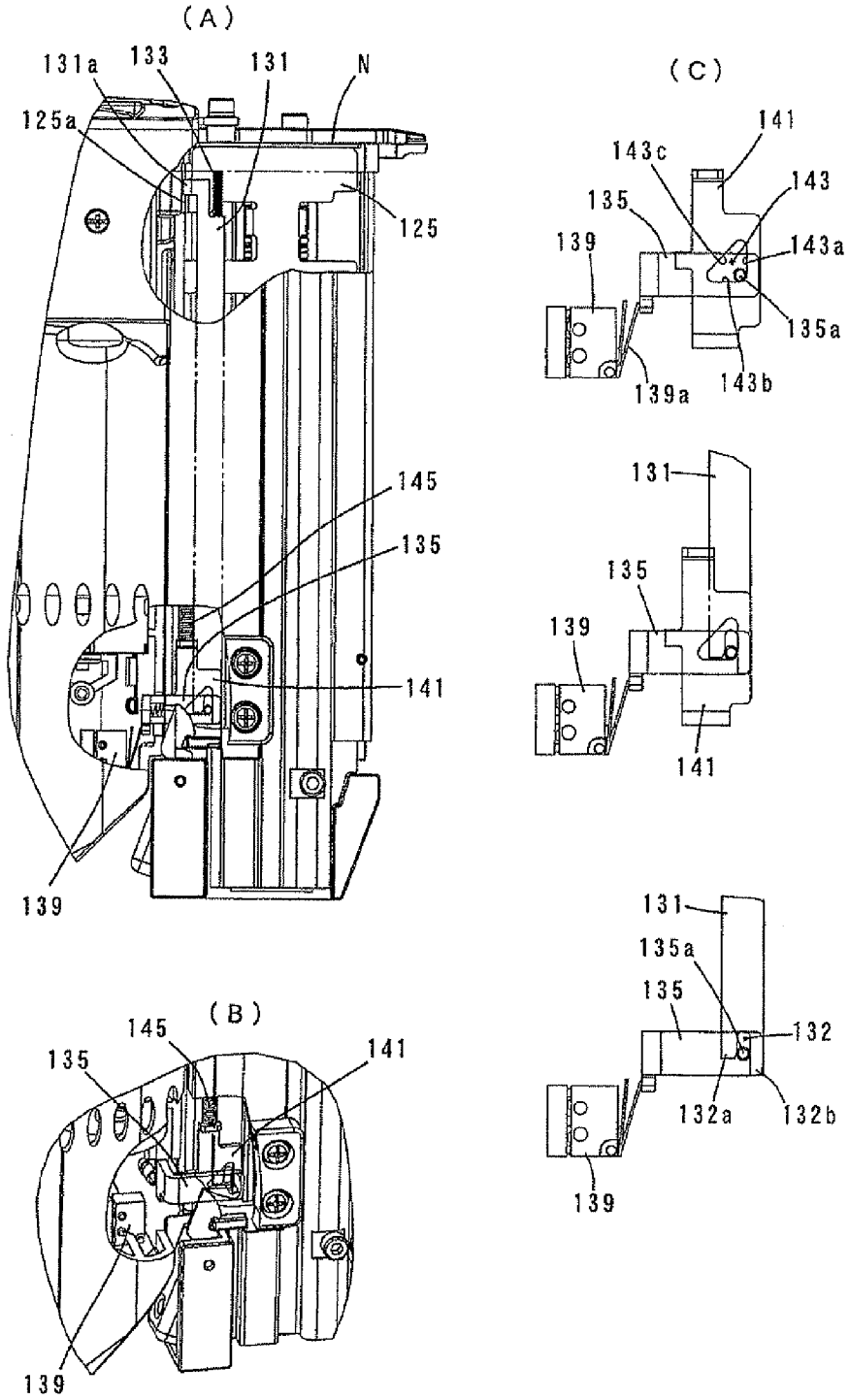

When the nail driving operation is performed by the nailing machine 100, the pusher 125 moves straight upward in order to feed the nails N to the driver guide 115. When the number of nails N remaining in the magazine body 121 becomes fewer, the actuating protrusion 125*a* of the pusher 125 comes in contact with the passive part 131*a* of the slide plate 131. When the number of remaining nails N decreases even further, the pusher 125 begins to pull the slide plate 131 straight upward. This state is shown in FIG. 9.

Figure 10:
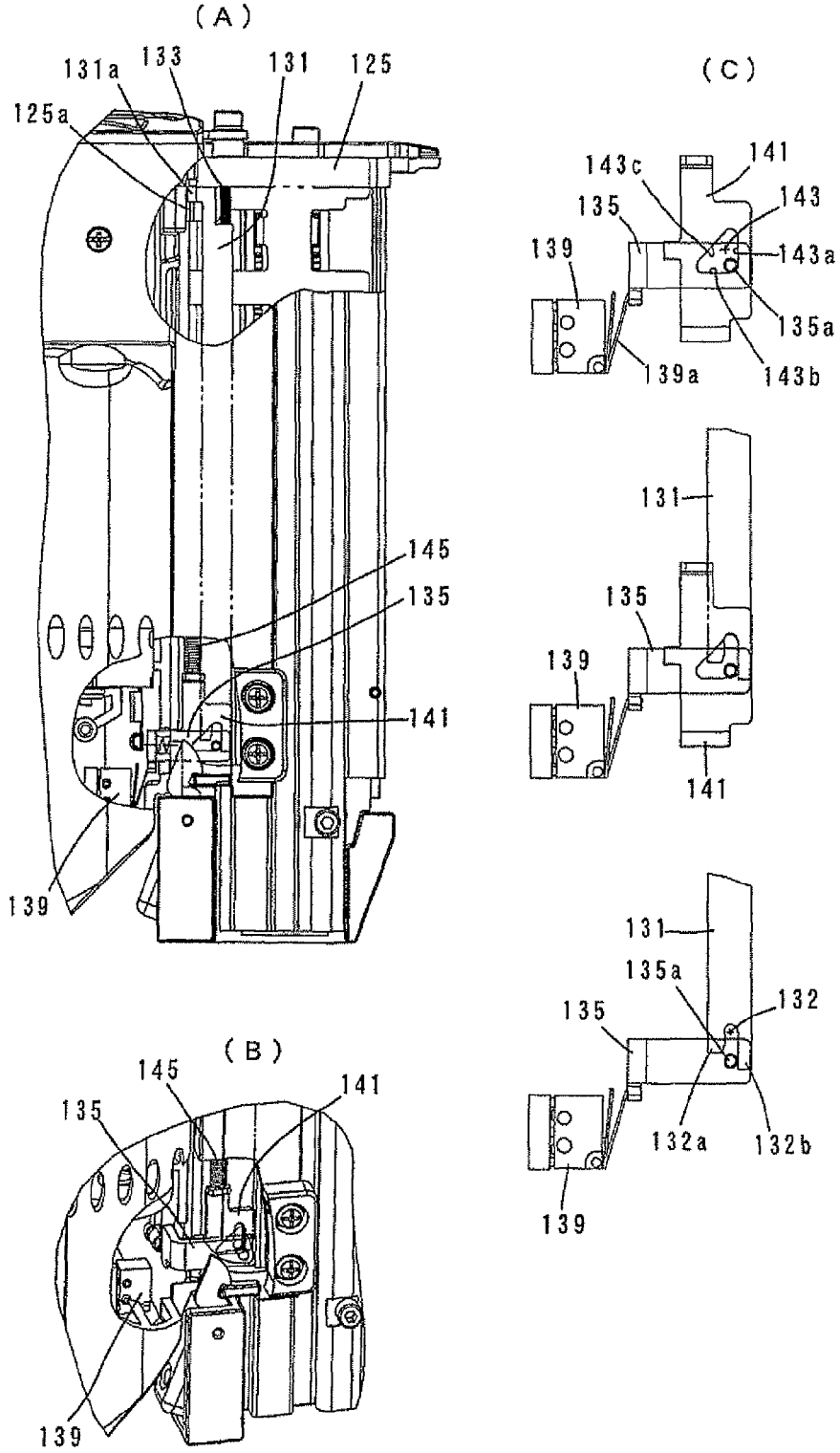

When the number of remaining nails N reaches the predetermined number, the slide plate 131 is further moved upward until the engagement element 135*a* of the switch block 135 is separated from the rear wall 132 of the slot 132 of the slide plate 131, so that the engagement element 135*a* is disengaged from the slot 132. This state is shown in FIG. 10.

Figure 11:
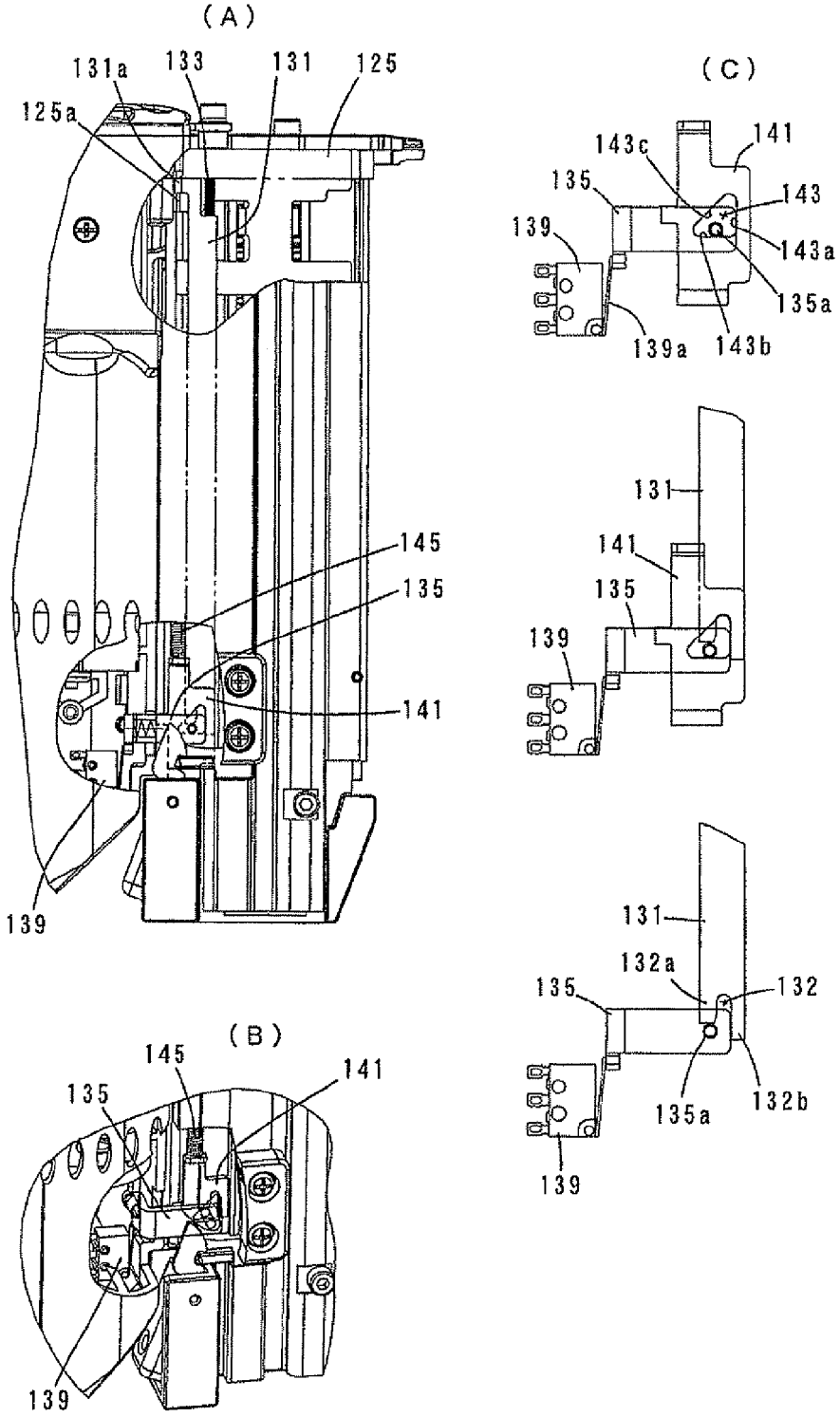

When the engagement element 135*a* is disengaged from the slot 132, the switch block 135 is moved straight rearward by the biasing force of the second spring 137. By this movement, the rear end of the switch block 135 pushes the actuating element 139*a* of the electric switch 139 so that the electric switch 139 is switched from the off state to the on state. At this time, the engagement element 135*a* of the switch block 135 is opposed to both the inclined surface 143*c* of the engagement hole 143 of the return plate 141 and the lower surface of the rear wall 132*a* of the slot 132 of the slide plate 131 and spaced a predetermined distance from each of them. This state is shown in FIG. 11.

When the electric switch 139 is switched to the on state, the switching signal of the electric switch 139 is inputted to the controller for controlling the driving motor. When the switching signal of the electric switch 139 switched to the on state is inputted to the controller, the controller prevents energization of the driving motor. Therefore, even if the contact arm is pressed against the workpiece and the trigger 103*a* is depressed, the driving motor is not energized, so that the idle driving of the nails N is prevented.

Figure 12:
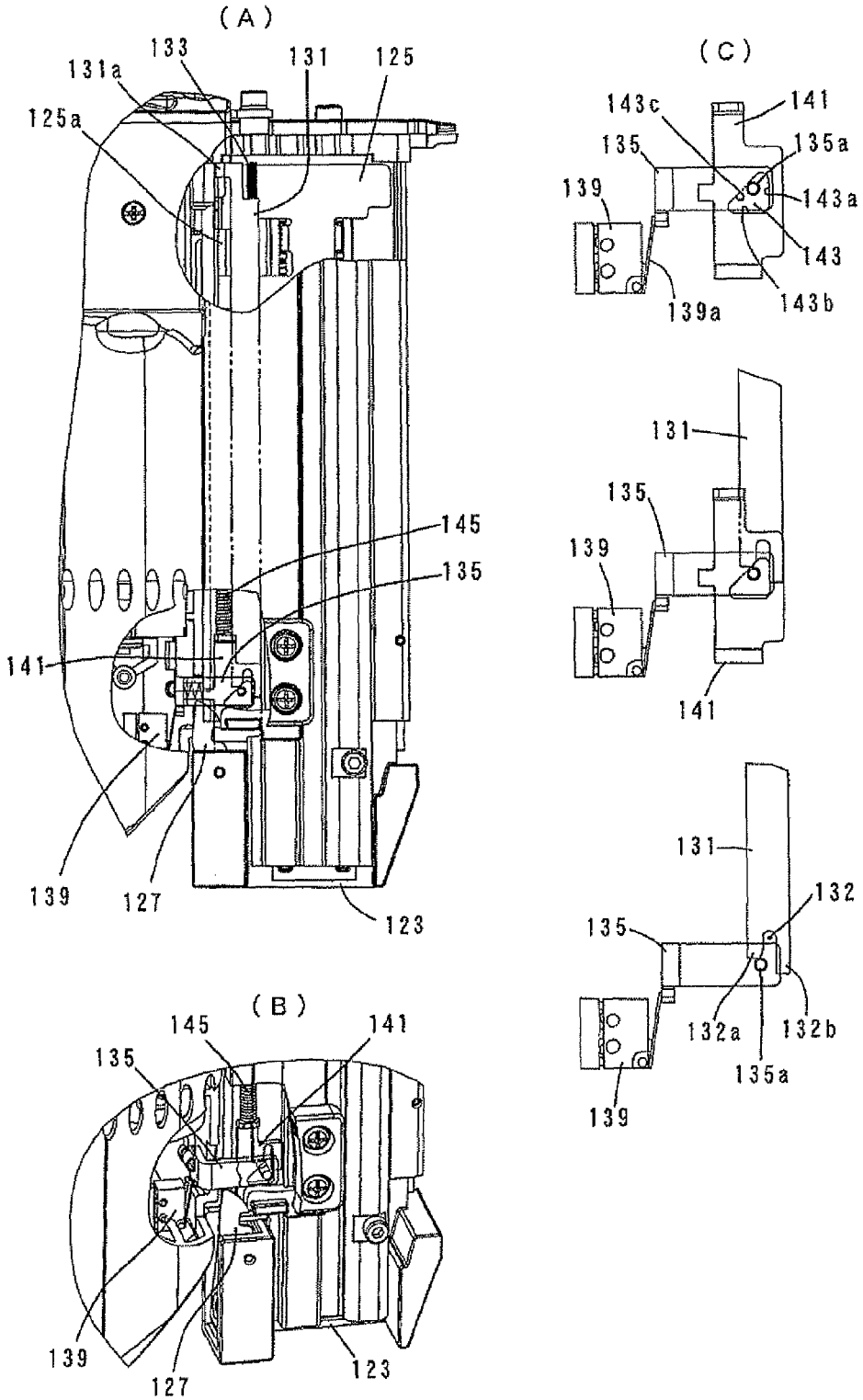

When the number of remaining nails N in the magazine body 121 reaches the predetermined number, the user loads the nails N into the magazine body 12. For this purpose, the user opens the magazine body 121 by releasing the door lock 127 and pulling out the slide door 123 downward. At this time, the stopper 147 is moved downward together with the slide door 123, so that the return plate 141 is disengaged from the stopper 147. Therefore, the return plate 141 is moved downward by the biasing force of the third spring 145 and the engagement element 135*a* of the switch block 135 is pushed by the inclined surface 143*c* of the engagement hole 143. The switch block 135 with the engagement element 135*a* pushed by the inclined surface 143*c* is moved straight forward against the biasing force of the second spring 137. At this time, although the biasing force of the first spring 133 is applied to the slide plate 131 to move it downward, the slide plate 131 is prevented from moving downward by the engagement element 135*a* which is held in contact with the lower surface of the rear wall 132*a* of the slot 132 during movement of the switch block 135. This state is shown in FIG. 12.

Figure 13:
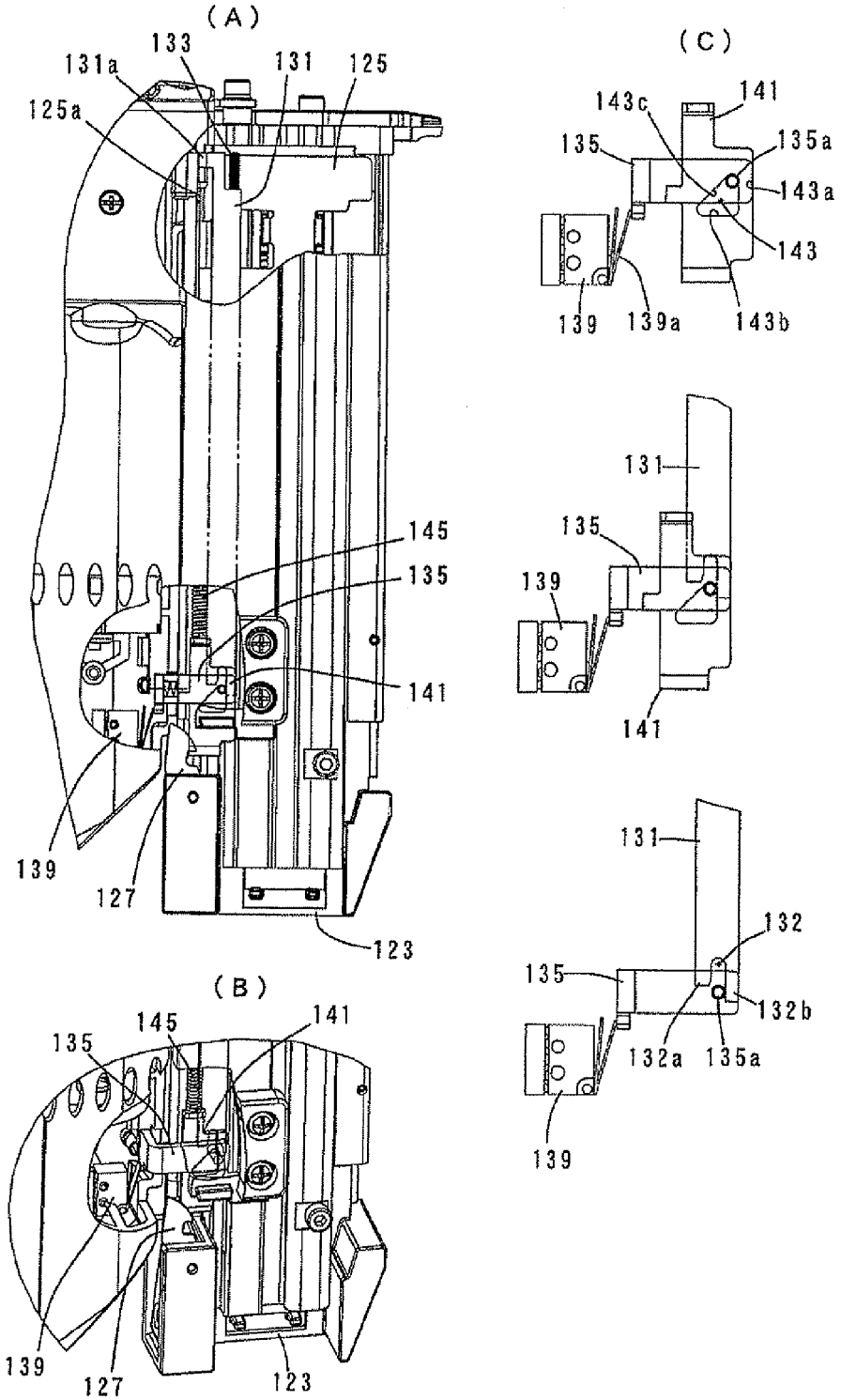

The engagement element 135*a* of the switch block 135 is pushed by the inclined surface 143*c* of the engagement hole 143 until completion of the downward movement of the return plate 141, so that the switch block 135 is returned to the initial forward position. At this time, the engagement element 135*a* passes the lower surface of the rear wall 132*a* of the slot 132 of the slide plate 131 and at the same time, it comes in contact with the front wall 132*b*. This state is shown in FIG. 13.

Figure 14:
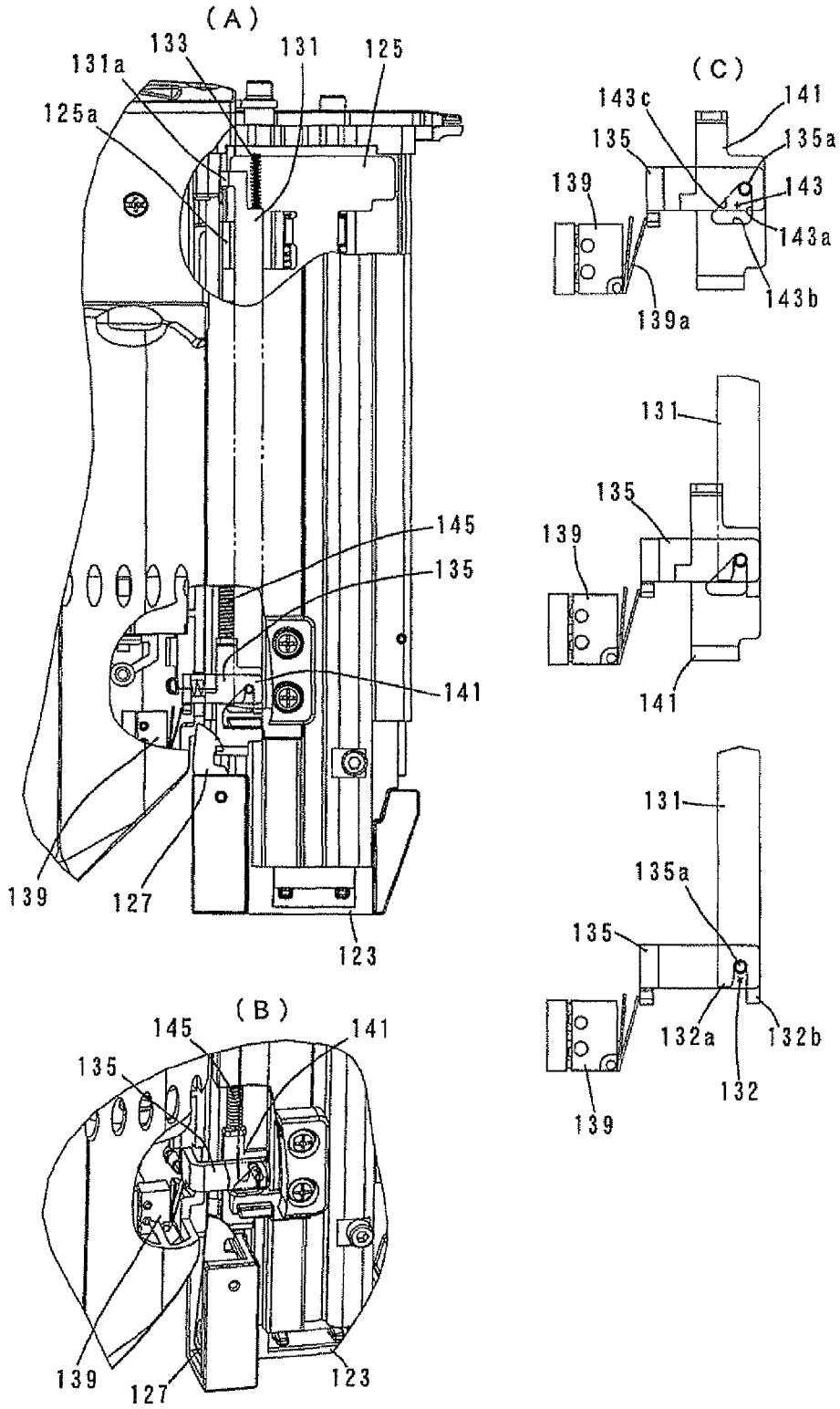

Then the slide plate 131 no longer interferes with the engagement element 135*a* so that the slide plate 131 is pushed downward by the biasing force of the first spring 133. As a result, the engagement element 135*a* is held engaged in the slot 132. This state is shown in FIG. 14.

Thereafter, when the user loads nails N into the magazine body 121 and then pushes up and closes the slide door 123, the return plate 141 is pushed up against the biasing force of the third spring 145 by the stopper 147 and returned to the initial position shown in FIG. 8.

As described above, in the idle driving prevention mechanism 130 of this embodiment, when the number of remaining nails N reach the predetermined number, the switch block 135 is no longer held by the slide plate 131, so that the switch block 135 is moved rearward by the biasing force of the second spring 137 and the electric switch 139 is actuated (turned on). Therefore, after moved rearward, the switch block 135 is held in the rearward position by the second spring 137, so that the occurrence of a malfunction of the switch block 135 is avoided. Thus, according to this embodiment, accuracy of the idle driving prevention mechanism 130 can be increased.

Further, according to this embodiment, the inclined surface 143*c* forming the cam face of the return plate 141 is utilized to return the switch block 135 from the rearward position or deactuating position in which the nails N are prevented from being driven, to the forward position or actuating position in which the nails N are allowed to be driven. With this construction, the returning movement of the switch block 135 from the rearward position to the forward position can be smoothly and rationally performed.

Further, according to this embodiment, the return plate 141 for returning the switch block 135 from the rearward position to the forward position is actuated in conjunction with the operation of loading (refilling) nails N into the magazine 105. Specifically, when the slide door 123 is opened (pulled downward) in order to load nails N into the magazine body 121, the return plate 141 is actuated in conjunction with opening of the slide door 123. Therefore, advantageously and rationally, the idle driving prevention mechanism 130 can be held in the idle driving prevented state unless nails N are loaded, and it is not necessary to perform an additional operation for returning the switch block 135.

Further, in this embodiment, the return plate 141 for returning the switch block 135 to the initial position or the actuating position is actuated in conjunction with the operation of opening the slide door 123. As an alternative to this construction, a lever member which can be turned from outside, for example, by a manual operation may be formed on the magazine 105 and the lever member may be mechanically connected to the return plate 141 such that the return plate 141 can be actuated by turning the lever member.

Further, in this embodiment, the nailing machine 100 is explained as a representative example of the driving tool according to the present invention, but the present invention may be applied to other driving tools such as a tacker and a stapler.

In view of the above-described aspects of the invention, the following features may be provided.

(1)

"The driving tool, including a driving member which moves rectilinearly and drives a fastener into a workpiece, and a magazine which stores a number of fasteners and feeds the fasteners one by one onto a working axis of the driving member, comprising:

a driving tool actuation control member that can be switched between an actuating position to allow actuation of the driving tool and a deactuating position to prevent actuation of the driving tool, and is constantly biased toward the deactuating position from the actuating position side, and a retaining member that can be engaged with the driving tool actuation control member and switched between a retaining position to retain the driving tool actuation control member in the actuating position by engagement with the driving tool actuation control member and a releasing position to release the driving tool actuation control member by disengagement from the driving tool actuation control member, wherein:

the retaining member is switched from the retaining position to the releasing position according to the number of remaining fasteners in the magazine, and when the retaining member is switched to the releasing position, the driving tool actuation control member is switched from the actuating position to the deactuating position, so that the driving tool can be held in a deactuated state."

(2)

"The driving tool as defined in any one of claims 1 to 3, comprising a motor for driving the driving member and an electric switch that can be switched between a power supply position in which power is supplied to the motor and a power shutoff position in which the power supply is shut off, wherein, when the driving tool actuation control member is placed in the deactuating position, the electric switch is switched to the power shutoff position."

(3)

"The driving tool as defined in any one of claims 1 to 3, wherein the driving tool actuation control member and the retaining member are housed in the magazine and a covering member is detachably mounted to the magazine and covers the driving tool actuation control member and the retaining member which are housed in the magazine."

(4)

"The driving tool as defined in any one of claims 1 to 3, wherein the switching movement of the driving tool actuation control member between the actuating position and the deactuating position is a rectilinear movement."

(5)

"The driving tool as defined in (4), wherein the switching movement of the retaining member between the retaining position and the releasing position is a rectilinear movement, and directions of the switching movements of the retaining member and the driving tool actuation control member intersect with each other."

DESCRIPTION OF NUMERALS

100 nailing machine (driving tool)
101 body
103 grip
103*a* trigger
105 magazine

107 body housing
109 motor housing
110 battery pack
115 driver guide
121 magazine body
123 slide door
125 pusher
125*a* actuating protrusion
127 door lock
127*a* hook
130 idle driving prevention mechanism
131 slide plate (retaining member)
131*a* passive part
132 slot
132*a* rear wall
132*b* front wall
133 first spring (biasing member)
135 switch block (driving tool actuation control member)
135*a* engagement element
137 second spring (biasing member)
139 electric switch
139*a* actuating element
141 return plate (cam)
143 engagement hole
143*a* rear surface
143*b* bottom surface
143*c* inclined surface (cam face)
145 third spring (biasing member)
147 stopper
149 covering member
149*a* engagement part
150 screw

What I claim is:

1. A driving tool having a driving member which moves rectilinearly and drives a fastener into a workpiece and a magazine which stores a plurality of fasteners and feeds the fasteners one by one onto a working axis of the driving member, the driving tool comprising:

a driving tool actuation control member switchable between an actuating position to allow actuation of the driving tool and a deactuating position to prevent actuation of the driving tool, the driving tool actuation control member being biased toward the deactuating position from the actuating position side, and a retaining member engageable with the driving tool actuation control member and switchable between a retaining position to retain the driving tool actuation control member in the actuating position by engagement with the driving tool actuation control member and a releasing position to release the driving tool actuation control member by disengagement from the driving tool actuation control member, wherein:

the retaining member is switched from the retaining position to the releasing position according to the number of remaining fasteners in the magazine, and the driving tool actuation control member is switched from the actuating position to the deactuating position when the retaining member is switched to the releasing position.

2. The driving tool as defined in claim 1, further comprising a cam member movable to return the driving tool actuation control member from the deactuating position to the actuating position, wherein the driving tool actuation control member is returned to the actuating position by movement of the cam member.

3. The driving tool as defined in claim 2, wherein the movement of the cam member is interlocked with refilling the fasteners into the magazine.

4. The driving tool as defined in claim 1, further comprising a motor for driving the driving member and an electric switch switchable between a power supply position in which power is supplied to the motor and a power shutoff position in which the power supply is shut off, wherein, when the driving tool actuation control member is placed in the deactuating position, the electric switch is switched to the power shutoff position.

5. The driving tool as defined in claim 1, wherein the driving tool actuation control member and the retaining member are housed in the magazine, and a covering member is detachably mounted to the magazine and covers the driving tool actuation control member and the retaining member which are housed in the magazine.

6. The driving tool as defined in claim 1, wherein switching movement of the driving tool actuation control member between the actuating position and the deactuating position is a rectilinear movement.

7. The driving tool as defined in claim 6, wherein switching movement of the retaining member between the retaining position and the releasing position is a rectilinear movement, and a direction of the switching movement of the retaining member and a direction of the switching movement of the driving tool actuation control member intersect with each other.

* * * * *